US010871056B2

(12) United States Patent
Navar et al.

(10) Patent No.: US 10,871,056 B2
(45) Date of Patent: Dec. 22, 2020

(54) WELLHEAD SYSTEMS AND METHODS

(71) Applicant: CAMERON INTERNATIONAL CORPORATION, Houston, TX (US)

(72) Inventors: Jose Navar, Houston, TX (US); Kythu Nguyen, Friendswood, TX (US); Dennis Nguyen, Pearland, TX (US); Delbert Vanderford, Cypress, TX (US); Jason Busch, Houston, TX (US); Haw Keat Lim, Singapore (SG)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 152 days.

(21) Appl. No.: 15/839,306

(22) Filed: Dec. 12, 2017

(65) Prior Publication Data

US 2018/0163520 A1 Jun. 14, 2018

Related U.S. Application Data

(60) Provisional application No. 62/432,808, filed on Dec. 12, 2016.

(51) Int. Cl.

| | |
|---|---|
| ***E21B 43/10*** | (2006.01) |
| ***E21B 47/092*** | (2012.01) |
| ***E21B 47/095*** | (2012.01) |
| ***E21B 33/035*** | (2006.01) |
| ***E21B 33/04*** | (2006.01) |

(52) U.S. Cl.

CPC ..... *E21B 43/10* (2013.01); *E21B 33/0355* (2013.01); *E21B 33/04* (2013.01); *E21B 47/092* (2020.05); *E21B 47/095* (2020.05)

(58) Field of Classification Search

CPC ..... E21B 43/10; E21B 33/03; E21B 33/04; E21B 47/0905; E21B 47/091; E21B 33/0355

See application file for complete search history.

(56) References Cited

U.S. PATENT DOCUMENTS

| | | | |
|---|---|---|---|
| 4,138,144 A | 2/1979 | Pierce, Jr. | |
| 5,666,050 A | 9/1997 | Bouldin et al. | |
| 6,209,653 B1 | 4/2001 | Pringle | |
| 9,371,713 B2 * | 6/2016 | Kleppa | E21B 47/06 |

(Continued)

FOREIGN PATENT DOCUMENTS

| | | |
|---|---|---|
| WO | 2014018010 A1 | 1/2014 |
| WO | 2015166215 A2 | 11/2015 |

OTHER PUBLICATIONS

International Search Report and Written Opinion dated Mar. 26, 2018, for International Application No. PCT/US2017/065831 (16 pgs).

(Continued)

*Primary Examiner* — Michael R Wills, III
(74) *Attorney, Agent, or Firm* — Conley Rose PC

(57) ABSTRACT

A wellhead system includes a wellhead including a position sensor disposed in an inner surface of the wellhead, and a wellhead component to be installed in the wellhead, the wellhead component including a position indicator disposed in an outer surface of the wellhead component, wherein the position sensor is configured to transmit a position signal in response to the wellhead component entering into a predetermined aligned position in the wellhead.

18 Claims, 17 Drawing Sheets

(56) References Cited

U.S. PATENT DOCUMENTS

| | | | | |
|---|---|---|---|---|
| 2007/0039738 | A1* | 2/2007 | Fenton | E21B 33/043 166/368 |
| 2011/0083854 | A1* | 4/2011 | Jennings | E21B 33/035 166/348 |
| 2011/0253389 | A1 | 10/2011 | Nguyen | |
| 2012/0097383 | A1* | 4/2012 | Fenton | E21B 33/0385 166/65.1 |
| 2012/0292035 | A1* | 11/2012 | Fenwick | E21B 33/043 166/336 |
| 2013/0248171 | A1 | 9/2013 | Raynal et al. | |
| 2014/0014334 | A1* | 1/2014 | Mason | E21B 33/035 166/255.1 |
| 2014/0216757 | A1* | 8/2014 | Kleppa | E21B 47/0001 166/377 |
| 2015/0275653 | A1* | 10/2015 | Ringgenberg | E21B 33/062 166/336 |
| 2016/0090802 | A1 | 3/2016 | Nguyen | |
| 2016/0102512 | A1* | 4/2016 | Nguyen | E21B 23/02 166/379 |
| 2016/0186523 | A1* | 6/2016 | Nguyen | E21B 33/0415 166/382 |
| 2016/0319657 | A1* | 11/2016 | Szpunar | E21B 47/091 |
| 2017/0362910 | A1* | 12/2017 | Stephens | E21B 33/143 |

OTHER PUBLICATIONS

Extended Search Report issued in the EP Application 17879820.3, dated Jun. 9, 2020 (8 pages).

International Preliminary Report on Patentabilitiy issued in the PCT Application PCT/US2017/065831, dated Jun. 18, 2019 (12 pages).

* cited by examiner

WELLHEAD SYSTEMS AND METHODS

CROSS-REFERENCE TO RELATED APPLICATIONS

The present application claims benefit of U.S. provisional patent application No. 62/432,808 filed Dec. 12, 2016, and entitled "Wellhead Systems and Methods," which is incorporated herein in its entirety for all purposes.

STATEMENT REGARDING FEDERALLY SPONSORED RESEARCH OR DEVELOPMENT

Not applicable.

BACKGROUND

Hydrocarbon drilling and production systems require various components to access and extract hydrocarbons from subterranean earthen formations. Such systems generally include a wellhead assembly through which the hydrocarbons, such as oil and natural gas, are extracted. The wellhead assembly may include a variety of components, such as valves, fluid conduits, controls, casings, hangers, and the like to control drilling and/or extraction operations. In some operations, hangers, such as tubing or casing hangers, may be used to suspend strings (e.g., piping for various fluid flows into and out of the well) in the well. Such hangers may be disposed or received in a housing, spool, or bowl. In addition to suspending strings inside the wellhead assembly, the hangers provide sealing to seal the interior of the wellhead assembly and strings from pressure inside the wellhead assembly.

In some applications, an initial or calibrating run (i.e., a "dummy run") of equipment into the wellhead must be made where a mark is placed on a landing joint corresponding to the landing position of the equipment run into the wellhead. Subsequently, the wellhead is re-run into the wellhead and the mark made on the landing joint is used to determine if the equipment is properly landed within the wellhead. Besides requiring two separate operations of running the equipment into the wellhead, because the landing of the equipment within the wellhead may only be determined indirectly, via the use of the mark made on the landing joint, such a landing operation provides no means for verifying if the equipment is properly landed within the wellhead, creating a risk of improperly landing or misaligning the equipment that is landed and installed within the wellhead.

SUMMARY

An embodiment of a wellhead system comprises a wellhead comprising a position sensor disposed in an inner surface of the wellhead, and a wellhead component to be installed in the wellhead, the wellhead component comprising a position indicator disposed in an outer surface of the wellhead component, wherein the position sensor is configured to transmit a position signal in response to the wellhead component entering into a predetermined aligned position in the wellhead. In some embodiments, the wellhead component comprises a tubing or casing hanger. In some embodiments, the predetermined aligned position of the tubing or casing hanger comprises a position where a landing shoulder of the tubing or casing hanger physically engages a landing shoulder of the wellhead. In certain embodiments, the wellhead component comprises a bowl and a locking ring configured to releasably couple the bowl to the wellhead, wherein the bowl comprises a landing shoulder. In certain embodiments, the predetermined aligned position of the bowl comprises a position where the locking ring is aligned with a locking groove disposed in the inner surface of the wellhead. In some embodiments, the position indicator comprises a magnetic member and the position sensor comprises a magnetic sensor. In some embodiments, the position indicator comprises an acoustic signal generator and the position sensor comprises an acoustic sensor. In certain embodiments, the acoustic signal generator comprises a shear pin configured to a shear a terminal end thereof in response to the wellhead component entering into the predetermined aligned position. In certain embodiments, the wellhead system further comprises a signal transmitter in signal communication with the position sensor, wherein the signal transmitter is configured to transmit the position signal in real-time from the position sensor to a location distal the wellhead system.

An embodiment of a wellhead system comprises a wellhead comprising a bore, and a wellbore monitoring assembly coupled to the wellhead, wherein the wellbore monitoring assembly comprises a sensor package disposed in a sensor housing, and a window disposed in a receptacle of the wellhead. In some embodiments, the sensor package is configured to monitor conditions in the bore of the wellhead via the window disposed in the wellhead. In some embodiments, the window comprises a sapphire glass material. In certain embodiments, the wellhead system further comprises a sealing interface disposed between the window and the receptacle of the wellhead, wherein the sealing interface comprises a primary seal between the bore of the wellhead and the surrounding environment, a gasket disposed between the sensor housing and an outer surface of the wellhead, wherein the gasket comprises a secondary seal between the bore of the wellhead and the surrounding environment. In certain embodiments, the sensor package comprises a temperature sensor and a pressure sensor. In some embodiments, the wellhead system further comprises a signal transmitter in signal communication with the sensor package, wherein the signal transmitter is configured to transmit a sensor signal from the sensor package in real-time to a location distal the wellhead system.

An embodiment of a method of landing a wellhead component in a wellhead, comprises disposing the wellhead component in a bore of the wellhead, disposing the wellhead component in a predetermined aligned position in the bore of the wellhead, and transmitting a position signal from a position sensor in response to disposing the wellhead component in the predetermined aligned positioned. In some embodiments, the method further comprises transmitting the position signal in response to physically engaging a landing shoulder of the wellhead component with a landing shoulder of the wellhead. In some embodiments, the method further comprises transmitting the position signal in response to aligning a locking ring with a locking groove disposed in an inner surface of the wellhead. In certain embodiments, the method further comprises transmitting the position signal in response to an acoustic signal generator coupled to the wellhead component generating an acoustic position signal. In certain embodiments, the method further comprises transmitting the position signal in response to aligning a magnetic member of the wellhead component with the position sensor.

BRIEF DESCRIPTION OF THE DRAWINGS

For a detailed description of exemplary embodiments, reference will now be made to the accompanying drawings in which.

DETAILED DESCRIPTION

Figure 1:
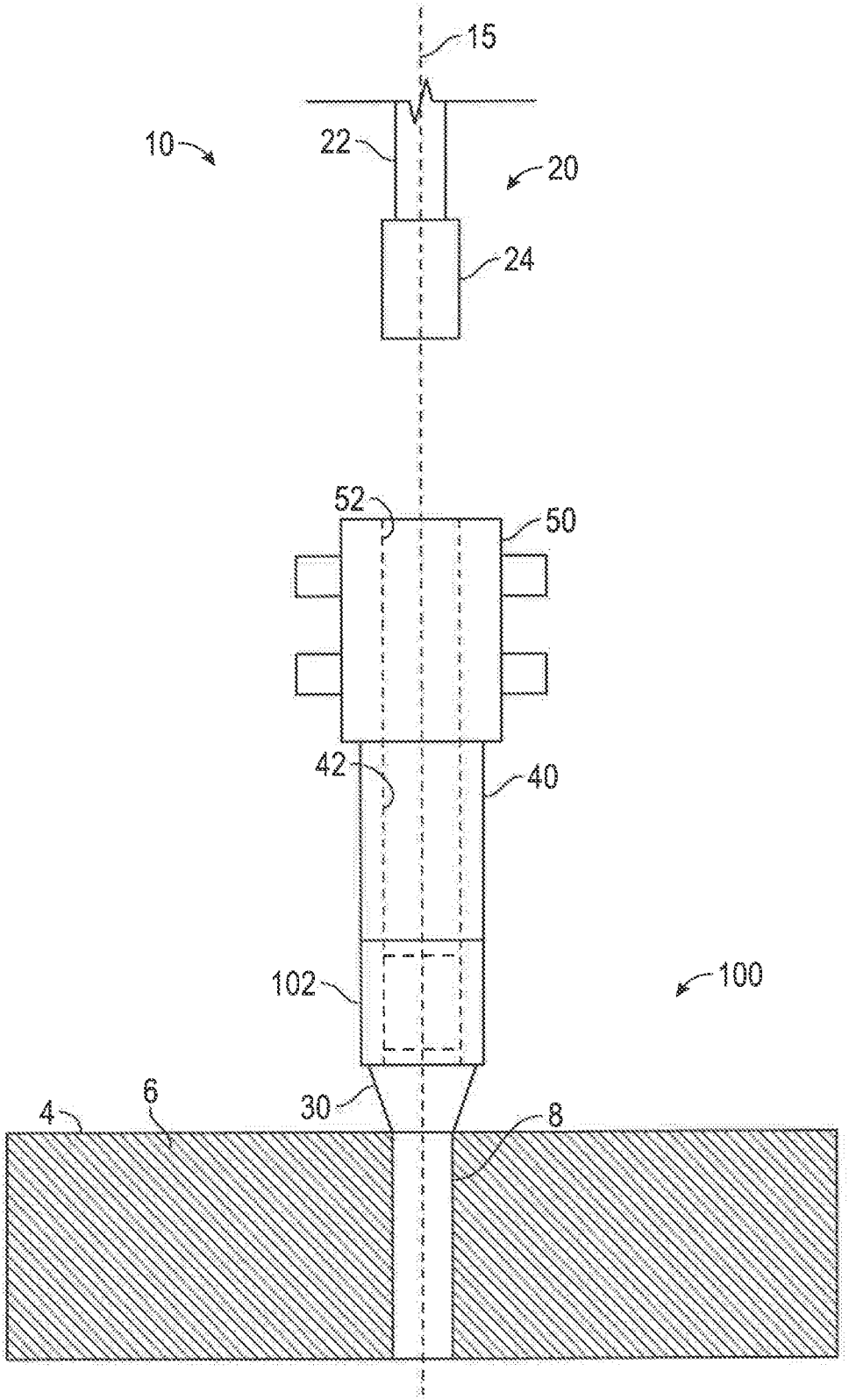
FIG. 1 is a schematic view of an embodiment of a well system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

FIG. 1 is a schematic diagram showing an embodiment of a well system 10 having a central or longitudinal axis 15. The well system 10 can be configured to extract various minerals and natural resources, including hydrocarbons (e.g., oil and/or natural gas), or configured to inject substances into an earthen surface 4 and an earthen formation 6 via a well or wellbore 8. In some embodiments, the well system 10 is land-based, such that the surface 4 is land surface, or subsea, such that the surface 4 is the seal floor. The system 10 includes a wellhead system 100 including a wellhead 102 that can receive a tool or tubular string conveyance 20. The wellhead 102 of wellhead system 100 is coupled to a wellbore 8 via a wellhead connector or hub 30. Wellhead 102 typically includes multiple components that control and regulate activities and conditions associated with the wellbore 8. For example, the wellhead 102 generally includes bodies, valves and seals that route produced fluids from the wellbore 8, provide for regulating pressure in the wellbore 8, and provide for the injection of substances or chemicals downhole into the wellbore 8. Although in the embodiment shown in FIG. 1 wellhead system 100 forms a part of well system 10, in other embodiments, wellhead system 100 may be used in other well systems.

In the embodiment shown in FIG. 1, well system 10 includes a Christmas tree or tree 40 coupled to the wellhead 102 of wellhead system 100 and a blowout preventer (BOP) stack 50 coupled to the tree 40. BOP stack 50 may include a variety of valves, fittings, and controls to prevent oil, gas, or other fluid from exiting the wellbore 8 in the event of an unintentional release of pressure or an overpressure condition. Additionally, in this embodiment wellhead system 100 includes a wellhead component 150 that is disposed within the wellhead 102 of wellhead system 100. In this embodiment, wellhead component 150 comprises a tubing and/or casing spool or housing. For ease of description below, reference to "tubing" shall include casing and other tubulars associated with wellheads. Further, "spool" may also be referred to as "housing," "receptacle," or "bowl."

The system 10 may include other devices that are coupled to the wellhead 102 of wellhead system 100, and devices that are used to assemble and control various components of the wellhead 102. For example, in the illustrated embodiment, well system 10 includes tool conveyance 20 including a tool 24 suspended from a tool or string 22. In certain embodiments, tool 24 comprises a running tool that is lowered (e.g., run) from an offshore vessel (not shown) to the wellbore 8 and/or the wellhead 102. In this embodiment, string 22 may comprise a drill string lowered from the offshore vessel. In other embodiments, such as land surface systems, tool 24 may include a device suspended over and/or lowered into the wellhead 102 via a crane or other supporting device.

The tree 40 generally includes a variety of flow paths, bores, valves, fittings, and controls for operating the wellbore 8. The tree 40 may provide fluid communication with the wellbore 8. For example, the tree 40 includes a tree bore 42. The tree bore 42 provides for completion and workover procedures, such as the insertion of tools into the wellbore 8, the injection of various substances into the wellbore 8, and the like. Further, fluids extracted from the wellbore 8, such as oil and natural gas, may be regulated and routed via the tree 40. As is shown in the system 10, the tree bore 42 may fluidly couple and communicate with a BOP bore 52 of the BOP stack 50.

In the embodiment shown in FIG. 1, wellhead 102 of wellhead system 100 provides a base for the tree 40 and BOP stack 50. In this embodiment, wellhead component 150 includes a wellhead component bore 152 that fluidly couples with and enables fluid communication between the tree bore 42 and the wellbore 8. Thus, bores 52, 42, and 152 provide access to the wellbore 8 for various completion and workover procedures. For example, components can be run down to the wellhead 102 and disposed in the wellhead component bore 152 to seal off the wellbore 8, to inject fluids downhole, to suspend tools downhole, to retrieve tools downhole, and the like. For instance, additional casing and/or tubing hangers may be installed within wellhead component 150 via the access provided by bores 52, 42, and 152. In some embodiments, wellhead component 150 is conveyed to the wellhead 102 via tool conveyance 20 for installation within a wellhead bore 104 of wellhead 102. Similarly, additional casing and/or tubing hangers may be conveyed to the wellhead 102 via tool conveyance 20 for installation within bore 152 of wellhead component 150. In certain embodiments, associated components of the casing and/or tubing hangers, such as seal or packoff assemblies, are installed within either wellhead bore 104 of wellhead 102 and/or wellhead component bore 152 of wellhead component 150 via tool 24 of conveyance tool 20. As will be described further herein, in some embodiments the tool 24 is configured to install wellhead component 150 and accessary components thereof within wellhead 102.

As one of ordinary skill in the art understands, the wellbore 8 may contain elevated pressures. For example, the wellbore 8 may include pressures that exceed 10,000 pounds per square inch (PSI). Accordingly, well system 10 employs various mechanisms, such as mandrels, seals, plugs and valves, to control and regulate the wellbore 8. For example, the wellhead component 150 may be disposed within the wellhead 102 to secure tubing and casing suspended in the wellbore 8, and to provide a path for hydraulic control fluid, chemical injections, and the like. In this embodiment, wellhead component bore 152 of wellhead component 150 is in fluid communication with the wellbore 8.

Figure 2A:
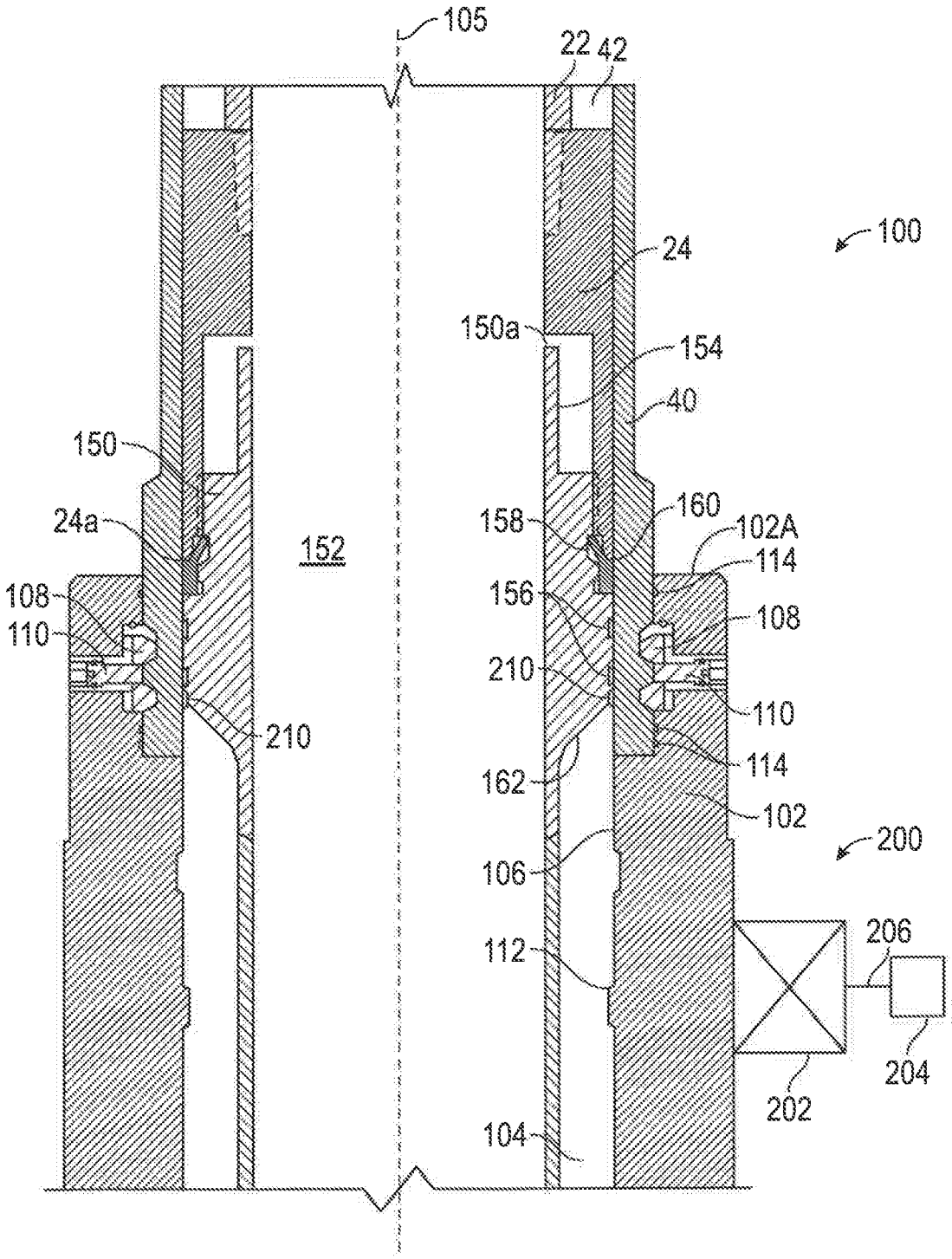
FIG. 2A is a schematic cross-sectional view of an embodiment of a wellhead system of the well system of FIG. 1, shown in a first position, in accordance with principles disclosed herein.
Figure 2B:
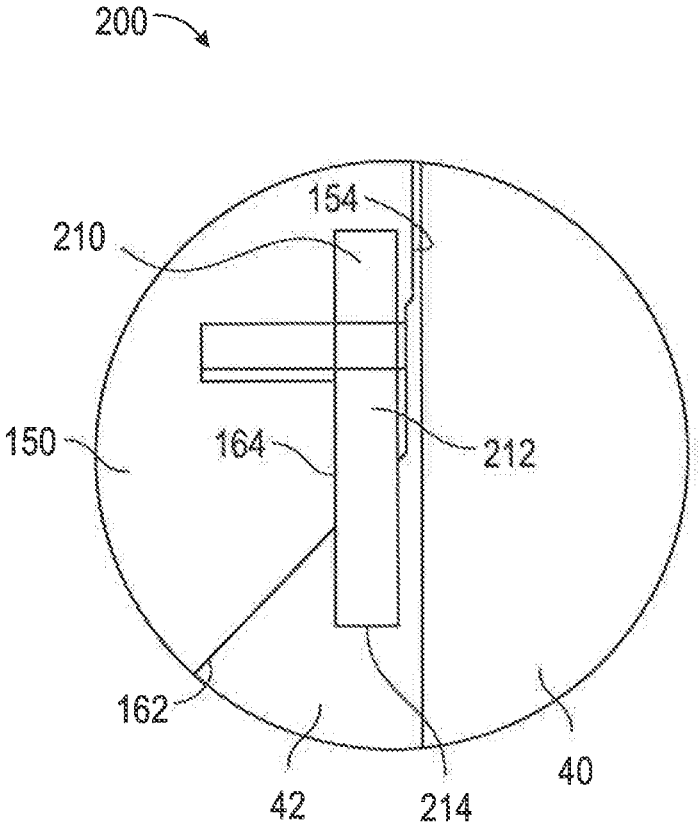
FIG. 2B is a zoomed-in, schematic view of an embodiment of a shear member of the wellhead system of FIG. 2A, shown in a first position, in accordance with principles disclosed herein.
Figure 3A:
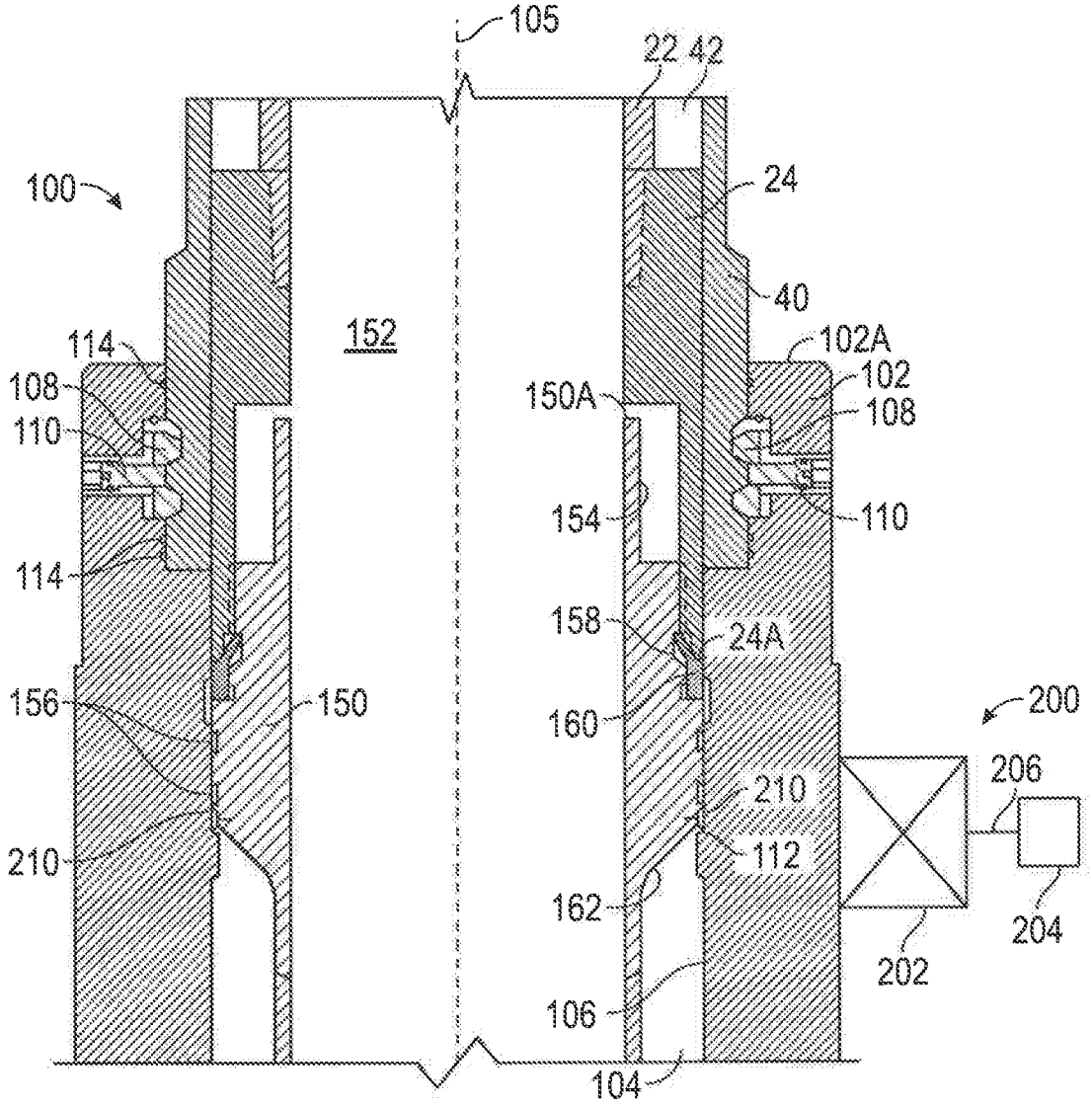
FIG. 3A is a schematic cross-sectional view of the wellhead system of FIG. 2A shown in a second position.
Figure 3B:
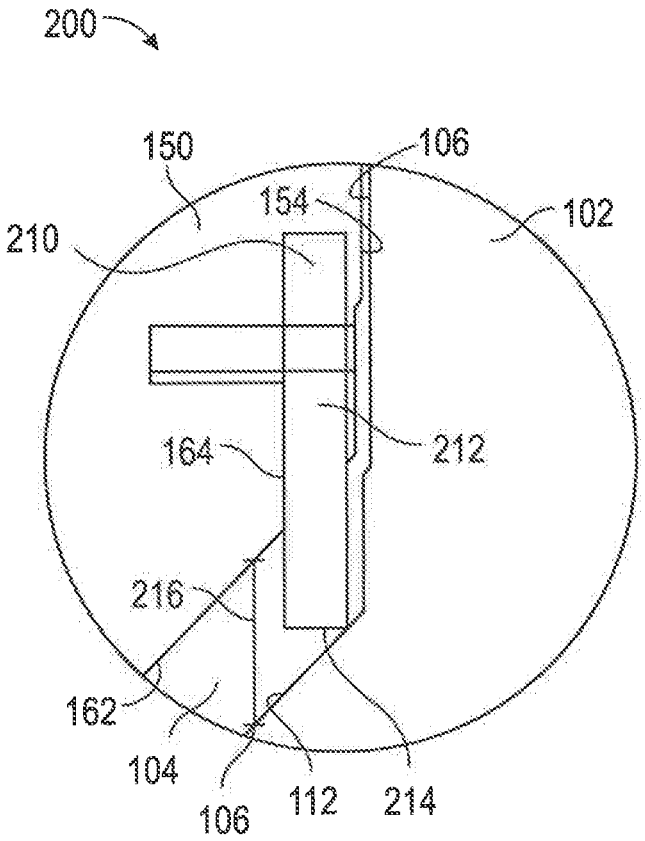
FIG. 3B is a zoomed-in schematic view of the shear member of FIG. 2B shown in a second position.

Referring to FIGS. 2A and 2B, in the embodiment shown wellhead system 100 includes a central or longitudinal axis 105 that is disposed coaxial with the central axis 15 of well system 10. Although wellhead system 100 is shown in FIG. 2A as only including wellhead 102 and hanger 150, in other embodiments, wellhead system 100 may include additional components not shown in FIG. 2A. Wellhead 102 includes a first or upper end 102A and a generally cylindrical inner surface 106 extending from upper end 102A, where inner surface 106 defines bore 104 of wellhead 102. Wellhead 102 is coupled to tree 40 via a plurality of radially actuatable locking members or dogs 108 disposed in the inner surface 106 of wellhead 102. Particularly, each dog 108 is radially actuatable via a corresponding pin 110 between a radially outer position out of engagement with tree 40, and a radially inner position where each dog 108 engages a groove disposed in an outer surface of tree 40. Although in this embodiment wellhead 102 is coupled with tree 40, in other embodiments, wellhead 102 may be directly coupled with BOP stack 50. In such embodiments, well system 10 may include tree 40. The inner surface 106 of wellhead 102 additionally includes an annular landing or engagement shoulder 112 extending radially inwards into bore 104. Landing shoulder 112 is configured to receive and physically engage wellhead component 150, as will be described further herein. Further, inner surface 106 includes a plurality of axially spaced annular seal assemblies 114 disposed therein and configured to sealingly engage an outer surface of tree 40 to isolate or seal bore 104 of wellhead 102 from the surrounding environment.

In the embodiment shown in FIGS. 2A and 2B, wellhead component 150 comprises a tubing or casing hanger 150 including a first or upper end 150A and a generally cylindrical outer surface 154 extending axially from upper end 150A. Outer surface 154 includes a pair of axially spaced seal assemblies 156 for sealingly engaging the inner surface 106 of wellhead 102 once hanger 150 has been installed within wellhead 102. Outer surface 154 of hanger 150 additionally includes an annular groove 158 that receives an annular locking member or ring 160 that is configured to releasably couple hanger 150 with a lower end 24A of tool 24. In this arrangement, hanger 150 may be displaced from a surface vessel disposed at a waterline to the wellhead 102 via tool 24, installed within wellhead 102, and released from tool 24 to allow tool 24 to be retracted to the surface vessel via string 22.

The outer surface 154 of hanger 150 includes an annular landing or engagement shoulder 162 configured to matingly engage with the landing shoulder 112 of wellhead 102. Specifically, physical engagement or contact between landing shoulder 162 of hanger 150 and landing shoulder 112 of wellhead 102 axially locates hanger 150 within wellhead 102. Thus, in some embodiments, once landing shoulder 162 of hanger 150 engages landing shoulder 112 of wellhead 102, hanger 150 may be installed within or locked to wellhead 102 and tool 24 may be disconnected from hanger 150 and retracted from wellhead system 100.

Wellhead system 100 additionally includes a position indication system 200 that is configured to provide a positive indication of proper axial location of hanger 150 within wellhead 102. In other words, position indication system 200 is configured to provide a signal or indication of the proper landing of hanger 150 within wellhead 102 or full physical engagement between landing shoulder 162 of hanger 150 and the landing shoulder 112 of wellhead 102. In the embodiment shown in FIGS. 2A and 2B, position indication system 200 generally includes a position sensor 202 comprising an acoustic sensor 202 coupled to an outer surface 116 of wellhead 102, where acoustic sensor 202 is in signal communication with a signal transmitter 204 via a cable or data link 206. Signal transmitter 204 is configured to provide real-time or near real-time transmission of data provided by acoustic sensor 202 to a location distal wellhead system 100. In some embodiments, signal transmitter 204 comprises a wireless transmitter configured to transmit a wireless data signal to a signal receiver, such as a receiver disposed on a surface vessel above wellhead system 100 at the waterline. In other embodiments, signal transmitter 204 comprises a hardwired connection between the acoustic sensor 202 and the signal receiver. For instance, in some embodiments transmitter 204 may comprise a hardwired connection routed along a marine riser extending between wellhead 102 and a surface vessel.

In this embodiment, position indication system 200 additionally comprises a plurality of circumferentially spaced acoustic signal generators or position indicators 210 coupled to hanger 150. Although in this embodiment position indication system 200 includes a plurality of acoustic signal generators 210, in other embodiments, position indication system 200 may only include a single acoustic signal generator 210. Further, although in this embodiment acoustic sensor 202 and signal transmitter 204 are coupled to wellhead 102 while acoustic signal generators 210 are coupled to hanger 150, in other embodiments, signal generators 210 may be coupled to wellhead 102 at or near landing shoulder 112 while acoustic sensor 202 and signal transmitter 204 are coupled to hanger 150.

Acoustic signal generators 210 are configured to provide or transmit an acoustic position signal to acoustic sensor 202 when hanger 150 enters a predetermined aligned position corresponding within wellhead 102. Particularly, in this embodiment, acoustic signal generators 210 are configured to transmit an acoustic position signal to acoustic sensor 202 in response to physical engagement between landing shoulder 162 of hanger 150 and landing shoulder 112 of wellhead 102. As shown particularly in FIG. 2B, in this embodiment each acoustic signal generator 210 comprises a shear pin or member 212 received within an aperture 164 extending into hanger 150. In this configuration, an outer terminal end 214 of shear pin 212 projects axially downwards (i.e., parallel with central axis 105) from landing shoulder 162 of hanger 150. Shear pin 212 of each acoustic signal generator 210 is positioned proximal a radially outer end of landing shoulder 162 such that shear pin 212 is disposed axially between landing shoulder 162 of hanger 150 of landing shoulder 112 of wellhead 102.

Referring to FIGS. 2A-4B, FIGS. 2A and 2B illustrate wellhead system 100 in a first or initial run-in position during the installation of wellhead component 150 within wellhead 102 via tool 24. In this position, landing shoulder 162 of hanger 150 is disposed distal landing shoulder 112 of wellhead 102. Tool 24 and string 22 axially convey hanger 150 downwards through the bore 104 towards the landing shoulder 112 of wellhead 102. FIGS. 3A and 3B illustrate hanger 150 once it has been conveyed to a position proximal to, but spaced from, landing shoulder 112 of wellhead 102. Particularly, in this second position of hanger 150, the terminal end 214 of the shear pin 212 of each acoustic signal generator 210 is disposed directly adjacent or contacts the landing shoulder 112 of wellhead 102. In the second position of hanger 150, a small axial gap 216 extends between landing shoulder 162 of hanger 150 and the landing shoulder 112 of wellhead 102, where axial gap 216 corresponds to or comprises the axial projection of shear pin 212 from the landing shoulder 162 of hanger 150. In this position, the terminal end 214 of the shear pin 212 of each acoustic signal generator 210 has yet to shear, and thus, has not transmitted an acoustic position signal to the acoustic sensor 202 of position indication system 200.

Figure 4A:
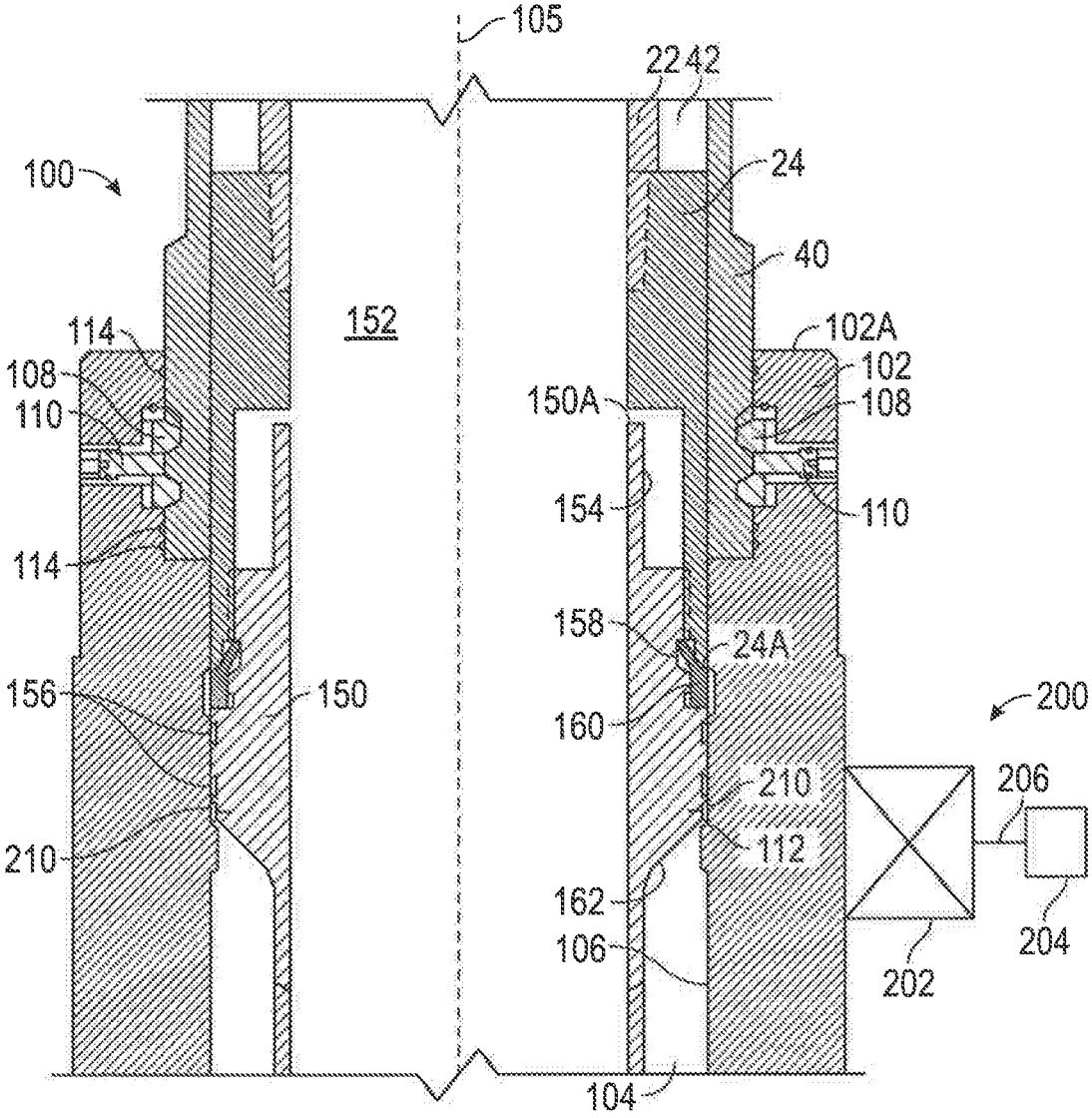
FIG. 4A is a schematic cross-sectional view of the wellhead system of FIG. 2A shown in a third position.
Figure 4B:
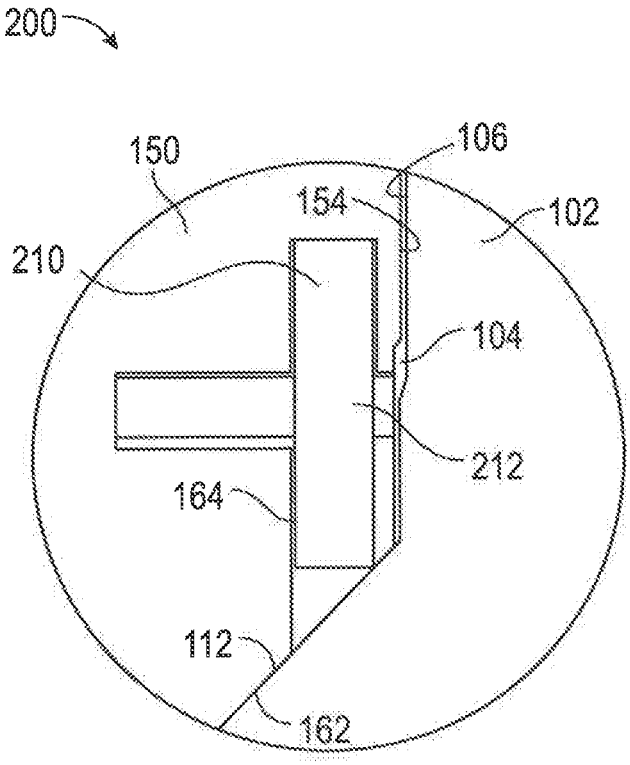
FIG. 4B is a zoomed-in schematic view of the shear member of FIG. 2B shown in a third position.

FIGS. 4A and 4B illustrate hanger 150 in a third or predetermined aligned position corresponding to a fully landed position of hanger 150 within the bore 104 of wellhead 102. In the third position of hanger 150, landing shoulder 162 of hanger 150 fully physically engages the landing shoulder 112 of wellhead 102, properly axially locating hanger 150 within bore 104 of wellhead 102. In the third position, the terminal end 214 of the shear pin 212 of each acoustic signal generator 210 has been sheared off via physical engagement between shear pin 212 and the landing shoulder 112 of wellhead 102. The shearing of the terminal end 214 of shear pins 212 generates an acoustic position signal that is transmitted to and received by the acoustic sensor 202. In this embodiment, shear pins 212 are configured to emit an acoustic position signal in response to the shearing of terminal end 214 that differs in acoustic frequency than the acoustic frequencies generated during normal operations of well system 10. Additionally, in this embodiment, acoustic sensor 202 is configured to filter the acoustic frequencies commonly generated during normal operations of well system 10 such that sensor 202 is configured to sense the unique or different frequency comprising the acoustic position signal emitted by shear pins 212 in response to the shearing of terminal ends 214.

When the acoustic position signal is transmitted from acoustic signal generators 210 in response to the shearing of the terminal end 214 of each shear pin 212, the acoustic position signal is received or sensed by the acoustic sensor 202. In this embodiment, acoustic sensor 202 is configured to transmit a position signal to signal transmitter 204 corresponding to the received acoustic position signal when hanger 150 enters the predetermined aligned position in wellhead 102. In response to receiving the position signal from acoustic sensor 202, signal transmitter 204 transmits the position signal to a location distal wellhead system 100, such as a surface vessel, where the position signal may be indicated to personnel of well system 10. The indication of the position signal provides a positive or direct indication of the proper landing of hanger 150 within the bore 104 of wellhead 102. For instance, in some embodiments, the indication of the position signal provides a positive or direct indication of physical engagement between landing shoulder 162 of hanger 150 and the landing shoulder 112 of wellhead 102.

Having received the indication of proper landing of hanger 150 within wellhead 102, personnel of well system 10 may finish the installation of hanger 150 within wellhead 102, decouple tool 24 from hanger 150, and retract string 22 and tool 24 coupled thereto from wellhead system 100. In this manner, a positive or direct indication of proper landing of hanger 150 within wellhead 102 may be provided via position indication system 200, obviating the need for a "dummy run" or other preliminary conveyance of hanger 150 (or other component installed in wellhead 102) into wellhead 102 in order to calibrate or indirectly determine the length of string 22 necessary to properly land hanger 150 within wellhead 102. Additionally, the positive or direct positioning indication provided by position indication system 200 reduces the risk of improperly or incompletely landing hanger 150 within wellhead 102 (i.e., a "false positive" landing) of which indirect positioning systems and methods are susceptible.

Figure 5A:
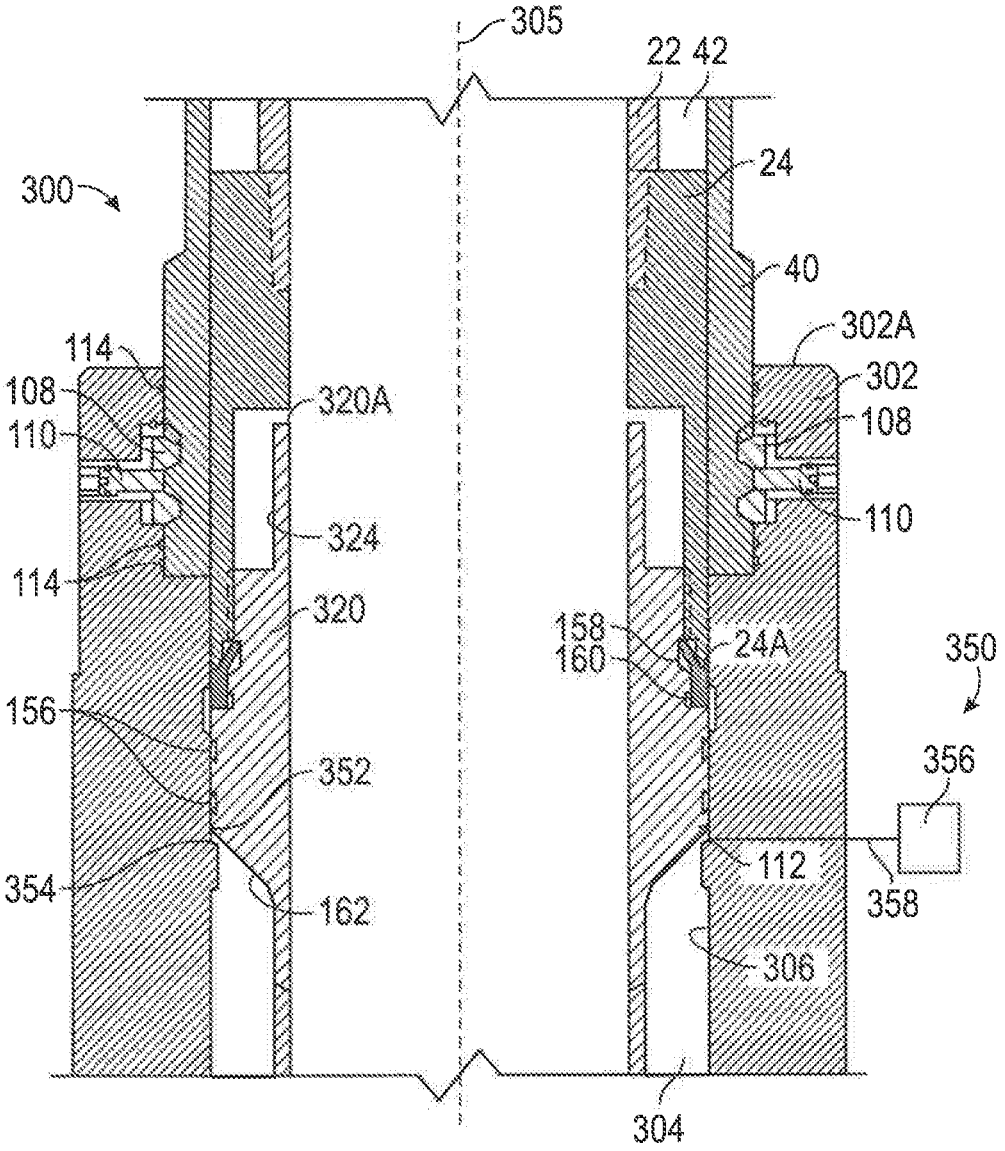
FIG. 5A is a schematic cross-sectional view of another embodiment of a wellhead system of the well system of FIG. 1, shown in a first position, in accordance with principles disclosed herein.
Figure 5B:
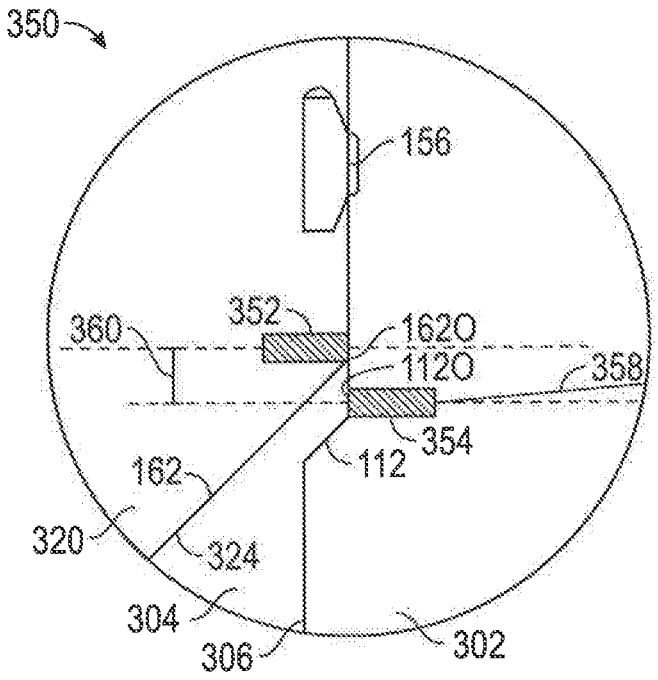
FIG. 5B is a zoomed-in, schematic view of an embodiment of a position indication system of the wellhead system of FIG. 5A, shown in a first position, in accordance with principles disclosed herein.

Referring to FIGS. 5A and 5B, another embodiment of a wellhead system 300 is shown. In this embodiment, wellhead system 300 has a central or longitudinal axis 305 that is disposed coaxial with the central axis 15 of well system 10 and generally includes a wellhead 302 and a wellhead component 320 comprising a tubing or casing hanger 320. Although wellhead system 300 is shown in FIG. 5A as only including wellhead 302 and hanger 320, in other embodiments, wellhead system 300 may include additional components not shown in FIG. 5A. Wellhead system 300 additionally includes a position indication system 350, as will be discussed further herein. Wellhead system 300 may comprise a component of well system 10 described above and shown in FIG. 1, or other well systems. Wellhead 302 and hanger 320 include features in common with wellhead 102 and hanger 150 of the wellhead system 100 described above, and shared features are labeled similarly. Wellhead 302 includes a bore 304 and a generally cylindrical inner surface 306 that extends axially from a first or upper end 302A of wellhead 302. Hanger 320 includes a bore 322 and a generally cylindrical outer surface 324 that extends axially from a first or upper end 320A of hanger 320. In this embodiment, the inner surface 306 of wellhead 302 includes landing shoulder 112 and the outer surface 324 of hanger 320 includes landing shoulder 162.

In the embodiment shown in FIGS. 5A and 5B, position indication system 350 generally includes an indicator member 352 disposed in the outer surface 324 of hanger 320 and an sensor 354 disposed in the inner surface 306 of wellhead 302. In this embodiment, indicator member 352 comprises a magnetic member 352 and sensor 354 comprises an annular magnetic sensor 354. Magnetic sensor 354 is configured to sense a magnetic field produced by the magnetic member 352 and transmit a position signal to a signal transmitter 356 via a cable or data link 358 when magnetic member 352 is disposed directly adjacent or in close proximity with magnetic sensor 354. In this embodiment, magnetic sensor 354 comprises a Hall effect sensor; however, in other embodiments, magnetic sensor 354 may comprise other sensors known in the art that are configured to respond to a magnetic field. In other embodiments, indicator member 352 may comprise a visual indicator while sensor 354 comprises an optical sensor configured to sense the presence of indicator member 352 when indicator member 352 enters the field of view of the sensor 354. In still further embodiments, sensor 354 may comprise other proximity sensors known in the art configured to output a signal in response to the disposition of an indicator within close proximity of sensor 354.

In the embodiment shown, magnetic member 352 is positioned at an outer radial end 162O (shown in FIG. 5B) of the landing shoulder 162 of hanger 320 while magnetic sensor 354 is positioned at an outer radial end 112O (shown in FIG. 5B) of the landing shoulder 112 of wellhead 302. In this arrangement, magnetic sensor 354 is configured to transmit the position signal to signal transmitter 356 in response to hanger 320 landing in wellhead 302 with landing shoulder 162 of hanger 320 in physical engagement or contacting landing shoulder 112 of wellhead 302. Signal transmitter 356 is configured similarly to signal transmitter 204 of position indication system 200 described above, and thus, is configured to transmit in real-time or near real-time the position signal provided by magnetic sensor 354 to a location remote wellhead system 300, such as a surface vessel disposed above wellhead system 300. Although in this embodiment magnetic sensor 354 is described as an annular sensor, in other embodiments, magnetic sensor 354 may comprise other shapes and geometries, including non-annular geometries.

Referring to FIGS. 5A-6B, FIGS. 5A and 5B illustrate wellhead component or hanger 320 of wellhead system 300 in a first position during the installation of wellhead component or hanger 320 within wellhead 302 via tool 24. In this position, landing shoulder 162 of hanger 320 is positioned proximal to, but axially spaced from, landing shoulder 112 of wellhead 302. As shown particularly in FIG. 5B, an axial gap or misalignment 360 extends between magnetic member 352 of hanger 320 and the magnetic sensor 354 of wellhead 302 when hanger 320 is disposed in the first position shown in FIGS. 5A and 5B, where axial gap 360 corresponds to the axial gap or distance extending between landing shoulder 162 of hanger 320 and the landing shoulder 112 of wellhead 302. In this embodiment, due to the existence of axial gap 360 between magnetic member 352 and magnetic sensor 354, magnetic sensor 354 does not transmit the position signal to signal transmitter 356.

Figure 6A:
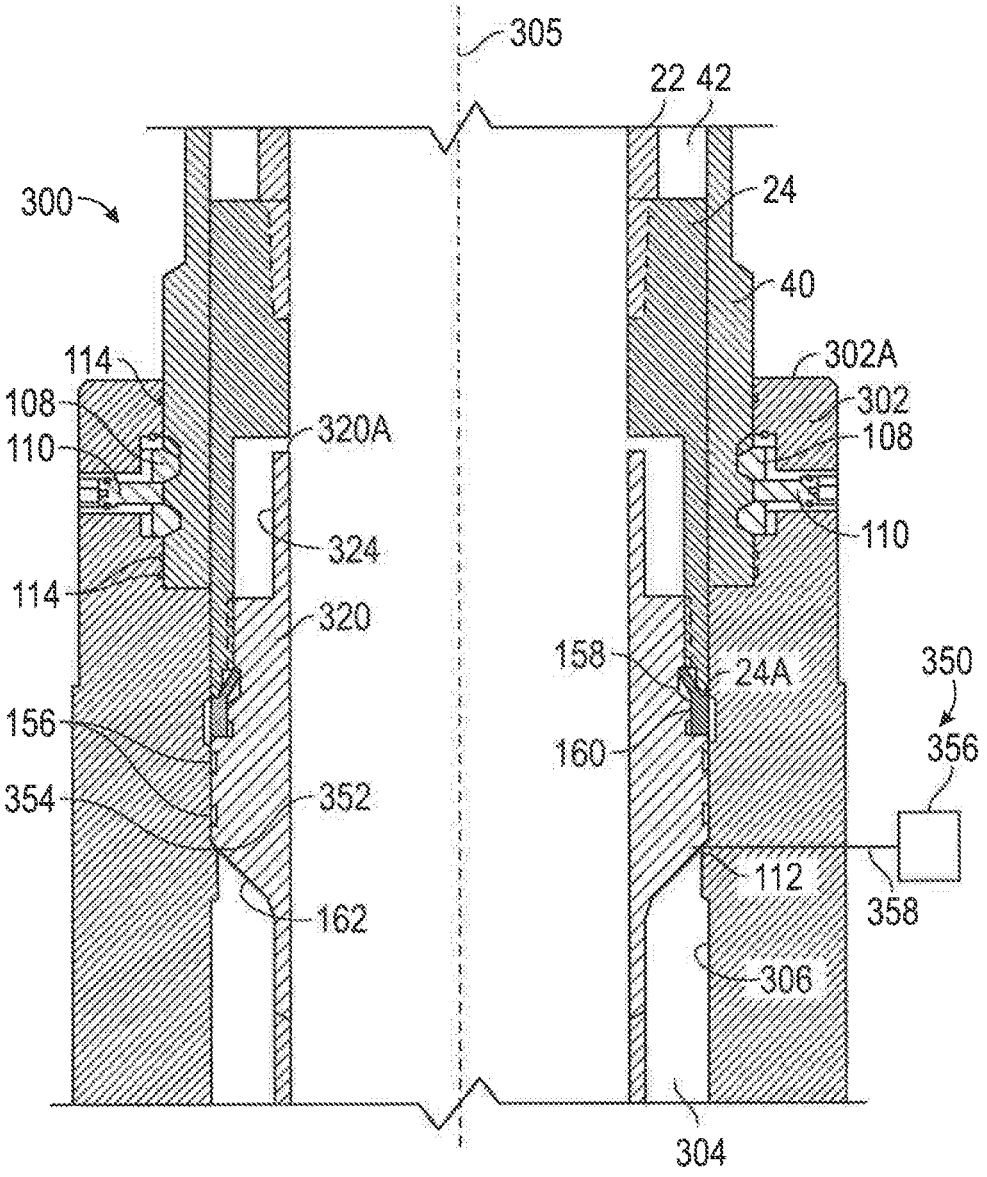
FIG. 6A is a schematic cross-sectional view of the wellhead system of FIG. 5A shown in a second position.
Figure 6B:
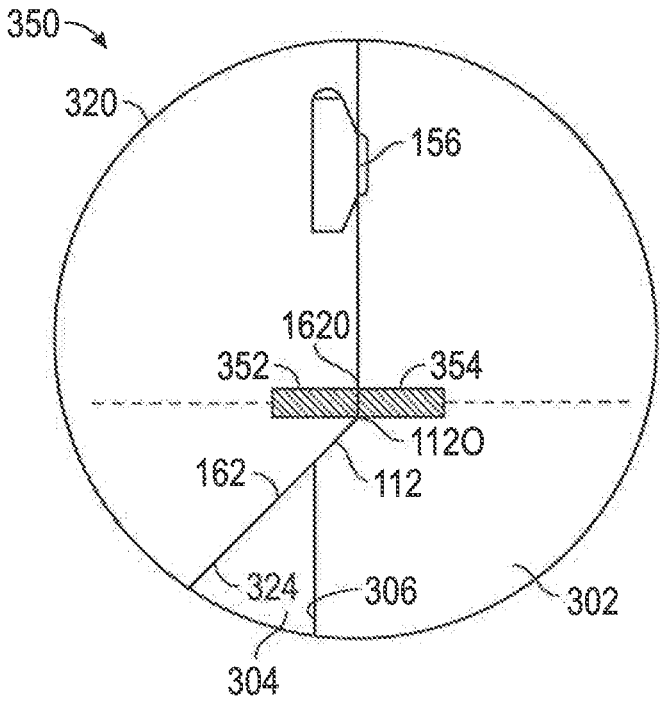
FIG. 6B is a zoomed-in schematic view of the position indication system of FIG. 5B shown in a second position.

FIGS. 6A and 6B illustrate hanger 320 in a second or predetermined aligned position corresponding to a fully landed position of hanger 320 within the bore 304 of wellhead 302. In the second position of hanger 302, landing shoulder 162 of hanger 302 physically engages the landing shoulder 112 of wellhead 302, axially locating hanger 320 within the bore 304 of wellhead 302. In this position of hanger 320, the magnetic member 352 is axially aligned with magnetic sensor 354, as shown particularly in FIG. 6B. In this arrangement, magnetic sensor 354, in response to sensing the magnetic field produced by magnetic member 352 when magnetic member 352 is in axial alignment with sensor 354, transmits the position signal to signal transmitter 356 via cable 358. Having received the position signal from magnetic sensor 354, signal transmitter 356 transmits the position signal to a location distal wellhead system 300, such as a surface vessel, where the position signal may be indicated to personnel of well system 10. The indication of the position signal provides a positive or direct indication of the proper landing of hanger 320 within the bore 304 of wellhead 302.

In some embodiments, the indication of the position signal provides a positive or direct indication of physical engagement between landing shoulder 162 of hanger 320 and the landing shoulder 112 of wellhead 302, similar to the operation of signal transmitter 204 discussed above. Although in this embodiment magnetic sensor 354 does not transmit the position signal until axial alignment is achieved between magnetic member 352 and magnetic sensor 354, in other embodiments, magnetic sensor 354 may output a position signal that varies in power or voltage as magnetic member 352 approaches the axial alignment with magnetic sensor 354 shown in FIG. 6B. In such an embodiment, signal transmitter 356 may be configured to only transmit the position signal upon receiving a threshold voltage from magnetic sensor 354 that corresponds with axial alignment between magnetic member 352 and magnetic sensor 354.

Figure 7A:
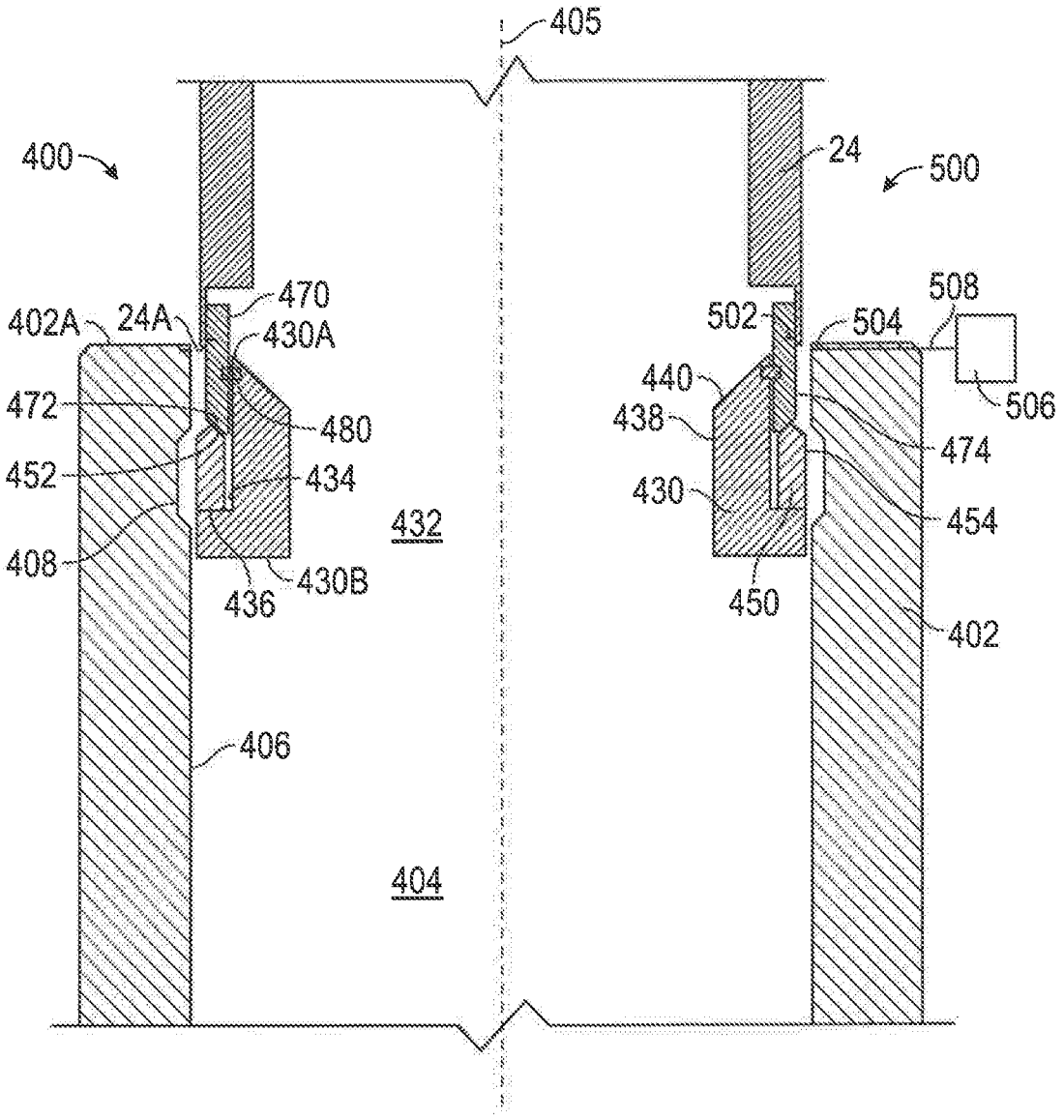
FIG. 7A is a schematic cross-sectional view of another embodiment of a wellhead system of the well system of FIG. 1, shown in a first position, in accordance with principles disclosed herein.
Figure 7B:
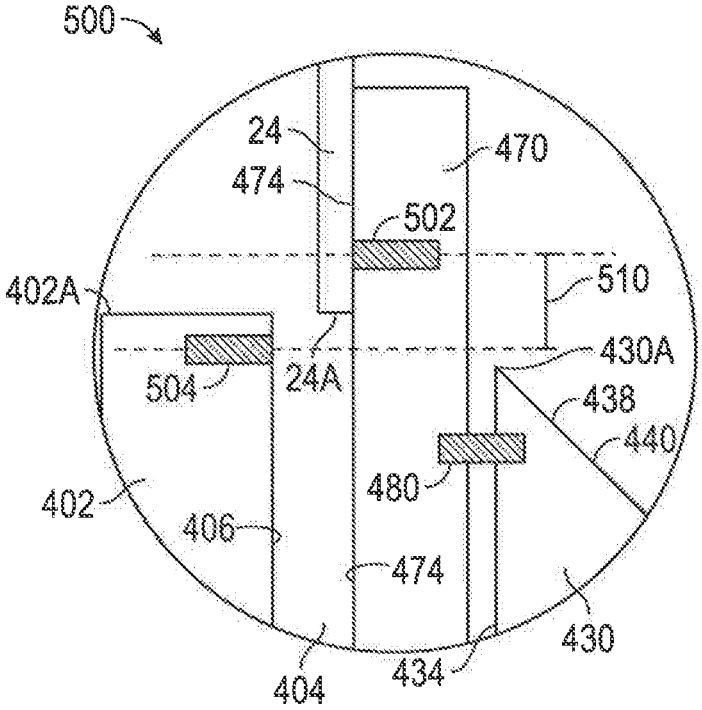
FIG. 7B is a zoomed-in, schematic view of an embodiment of a position indication system of the wellhead system of FIG. 5A, shown in a first position, in accordance with principles disclosed herein.

Referring to FIGS. 7A and 7B, another embodiment of a wellhead system 400 is shown. In this embodiment, wellhead system 400 has a central or longitudinal axis 405 that is disposed coaxial with central axis 15 of well system 10 and generally includes a wellhead 302 and a wellhead component 430 comprising a bowl or spool 430. Although wellhead system 400 is shown in FIG. 7A as only including wellhead 402 and bowl 430, in other embodiments, wellhead system 400 may include additional components not shown in FIG. 7A. Wellhead system 400 includes a position indication system 500, as will be discussed further herein. Wellhead system 400 may comprise a component of well system 10 described above and shown in FIG. 1, or other well systems. Wellhead 402 of wellhead system 400 includes a bore 404 and a generally cylindrical inner surface 406 that extends axially from a first or upper end 402A of wellhead 402. In this embodiment, wellhead 402 comprises a "full bore" wellhead that does not include an internal landing shoulder, contra to wellheads 102 and 302 described above, each of which included landing shoulder 112. Full bore wellhead 402 provides greater inner diameter therein for more convenient access to wellbore 8. In this embodiment, the inner surface 406 of wellhead 402 includes an annular locking groove 408 extending radially therein and positioned proximal upper end 402A.

Bowl 430 of wellhead system 400 may be releasably coupled with wellhead 402 via locking groove 408 and is configured to provide a landing shoulder for additional components installed within wellhead 402, such as casing or tubing hangers. In the embodiment shown in FIGS. 7A and 7B, bowl 430 includes a bore 432 extending between a first or upper end 430A and a second or lower end 430B of bowl 430. Bowl 430 additionally includes a generally cylindrical outer surface 434 that extends between ends 430A and 430B and includes an annular, radially outwards extending shoulder 436 that is positioned proximal lower end 430B. Further, bowl 430 includes a generally cylindrical inner surface 438 extending between ends 430A and 430B and including an annular landing shoulder 440 extending from upper end 430A. Landing shoulder 440 is configured to physically engage a corresponding landing shoulder of a wellhead component to be landed within wellhead 402. For instance, in some embodiments, landing shoulder 440 of bowl 430 may be used to land hanger 150 or hanger 320 within wellhead 402 of wellhead system 400.

Wellhead system 400 additionally includes an annular locking ring 450 and an annular engagement ring 470 releasably coupled with tool 24. Locking ring 450 is configured to releasably lock bowl 430 to wellhead 402 via physical engagement with the inner surface 406 of wellhead 402. Particularly, locking ring 450 includes a radially inner or unlocked position (shown in FIG. 7A) where locking ring 450 is clear of locking groove 408 of wellhead 402, and a radially outer or locked position (not shown) where locking ring 450 is at least partially disposed within locking groove 408. In the locked position, relative axial movement between locking ring 450 and wellhead 402 is restricted via interfering engagement provided by shoulder 436 of bowl 430 and engagement ring 470, thereby locking bowl 430 to wellhead 402. Engagement ring 470 is configured to actuate locking ring 450 between unlocked and locked positions in response to actuation from tool 24, such as the application of a torque to engagement ring 470 from tool 24. In this embodiment, engagement ring 470 is coupled with bowl 430 via a connecting member 480 extending radially therebetween. Particularly, in this embodiment an upper end of locking ring 450 includes an engagement shoulder 452 while a lower end of engagement ring 470 includes a corresponding engagement shoulder 472. In this arrangement, relative axial movement between engagement ring 470 and locking ring 450 (via actuation of tool 24) actuates locking ring radially between the unlocked and locked positions.

Position indication system 500 of wellhead system 400 is configured to provide an indication when bowl 430 and locking ring 450 are axially aligned with locking groove 408 of wellhead 402. In the embodiment shown in FIGS. 7A and 7B, position indication system 500 generally includes an indicator member 502 and a sensor 504. In this embodiment, indicator member 502 is positioned on an outer surface 474 of engagement member 470 and comprises a magnetic member 502 similar in configuration to magnetic member 352 of position indication system 350. However, in other embodiments, magnetic member 502 may be positioned on an outer surface 454 of locking ring 450 or the outer surface 343 of bowl 430. Additionally, in other embodiments, magnetic member 502 may comprise another form of indicator member, such as a visual indicator. In the embodiment shown, sensor 504 is positioned on the inner surface 406 of wellhead 402 and comprises a magnetic sensor 504 similar in configuration to magnetic sensor 354 of position indication system 350. However, in other embodiments, sensor 504 may comprise other proximity sensors known in the art, including optical sensors for detecting a visual indicator. For instance, indicator member 502 could comprise a shear pin configured to emit an acoustic positioning signal when locking ring 450 achieves axial alignment with locking groove 408 of wellhead 402, which could be received by sensor 504 with sensor 504 comprising an acoustic sensor. In this embodiment, position indication system 500 additionally comprises signal transmitter 506 and cable or data link 508, which are similar in configuration to signal transmitter 356 and cable 358 of position indication system 350 described above.

Referring to FIGS. 7A-8B, FIGS. 7A and 7B illustrate wellhead component or bowl 430 of wellhead system 400 in a first position during the installation of wellhead component or bowl 430 within wellhead 402 via tool 24. In this position, locking ring 450 is positioned proximal to, but axially spaced from, an axially aligned position with locking groove 408 of wellhead 402. As shown particularly in FIG. 7B, an axial gap or misalignment 510 extends between magnetic member 502 of bowl 430 and the magnetic sensor 504 of wellhead 402 when bowl 430 is disposed in the first position shown in FIGS. 7A and 7B, where axial gap 510 corresponds to the axial gap or distance extending between the position of locking ring 450 when bowl 430 is disposed in the first position and the axial position of locking ring 450 when locking ring 450 is axially aligned with locking groove 408 of wellhead 402. In this embodiment, due to the existence of axial gap 510 between magnetic member 502 and magnetic sensor 504, magnetic sensor 504 does not transmit the position signal to signal transmitter 506.

Figure 8A:
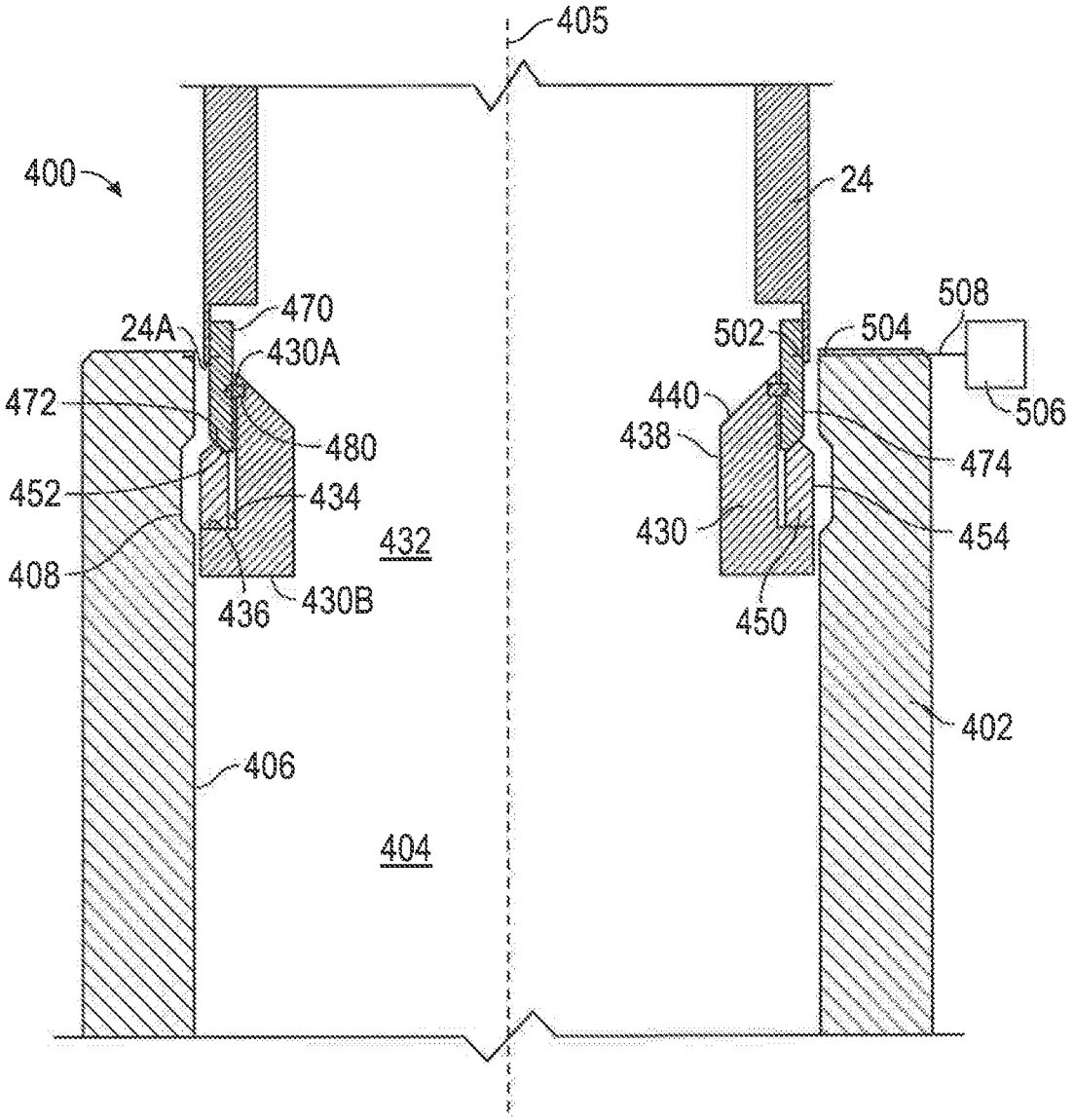
FIG. 8A is a schematic cross-sectional view of the wellhead system of FIG. 5A shown in a second position.
Figure 8B:
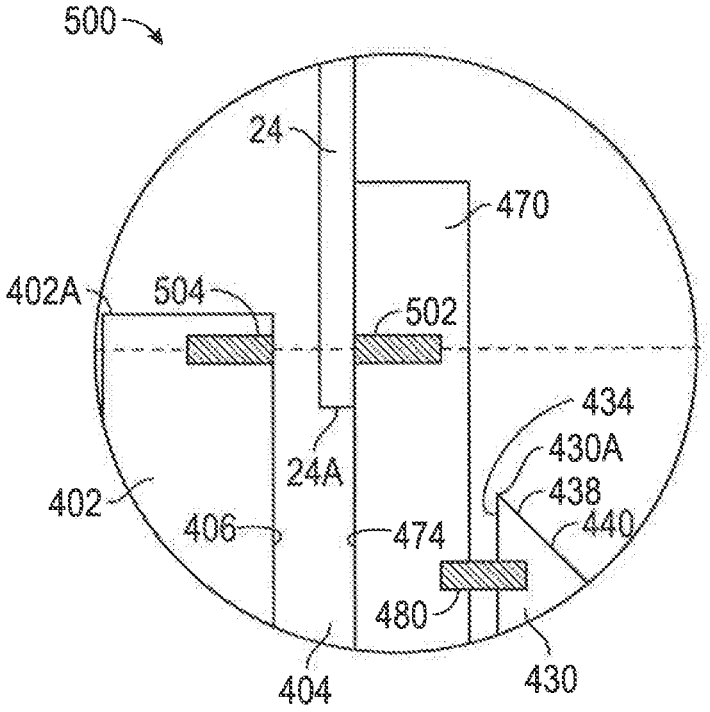
FIG. 8B is a zoomed-in schematic view of the position indication system of FIG. 5B shown in a second position.

FIGS. 8A and 8B illustrate bowl 430 in a second or predetermined aligned position corresponding to an axial position of locking ring 450 where locking 450 is axially aligned with locking groove 408 of wellhead 402. In the second position of bowl 430, magnetic member 502 is axially aligned with magnetic sensor 504, as shown particularly in FIG. 8B. In this arrangement, magnetic sensor 504, in response to sensing the magnetic field produced by magnetic member 502 when magnetic member 502 is in axial alignment with magnetic sensor 504, transmits the position signal to signal transmitter 506 via cable 508.

Having received the position signal from magnetic sensor 504, signal transmitter 506 transmits the position signal to a location distal wellhead system 400, such as a surface vessel, where the position signal may be indicated to personnel of well system 10. The indication of the position signal provides a positive or direct indication of axial alignment between locking ring 450 and locking groove 408 of wellhead 402. Although in this embodiment magnetic sensor 504 does not transmit the position signal until axial alignment is achieved between magnetic member 502 and magnetic sensor 504, in other embodiments, magnetic sensor 504 may output a position signal that varies in power or voltage as magnetic member 502 approaches the axial alignment with magnetic member 504 shown in FIG. 8B. In such an embodiment, signal transmitter 506 may be configured to only transmit the position signal upon receiving a threshold voltage from magnetic sensor 504 that corresponds with axial alignment between magnetic member 502 and magnetic sensor 504. Following the transmission of the position signal to a position distal wellhead system 400, such as a surface vessel, the engagement ring 470 may be actuated by tool 24 to actuate locking ring 450 into the locked position to lock bowl 430 to wellhead 402.

Figure 9:
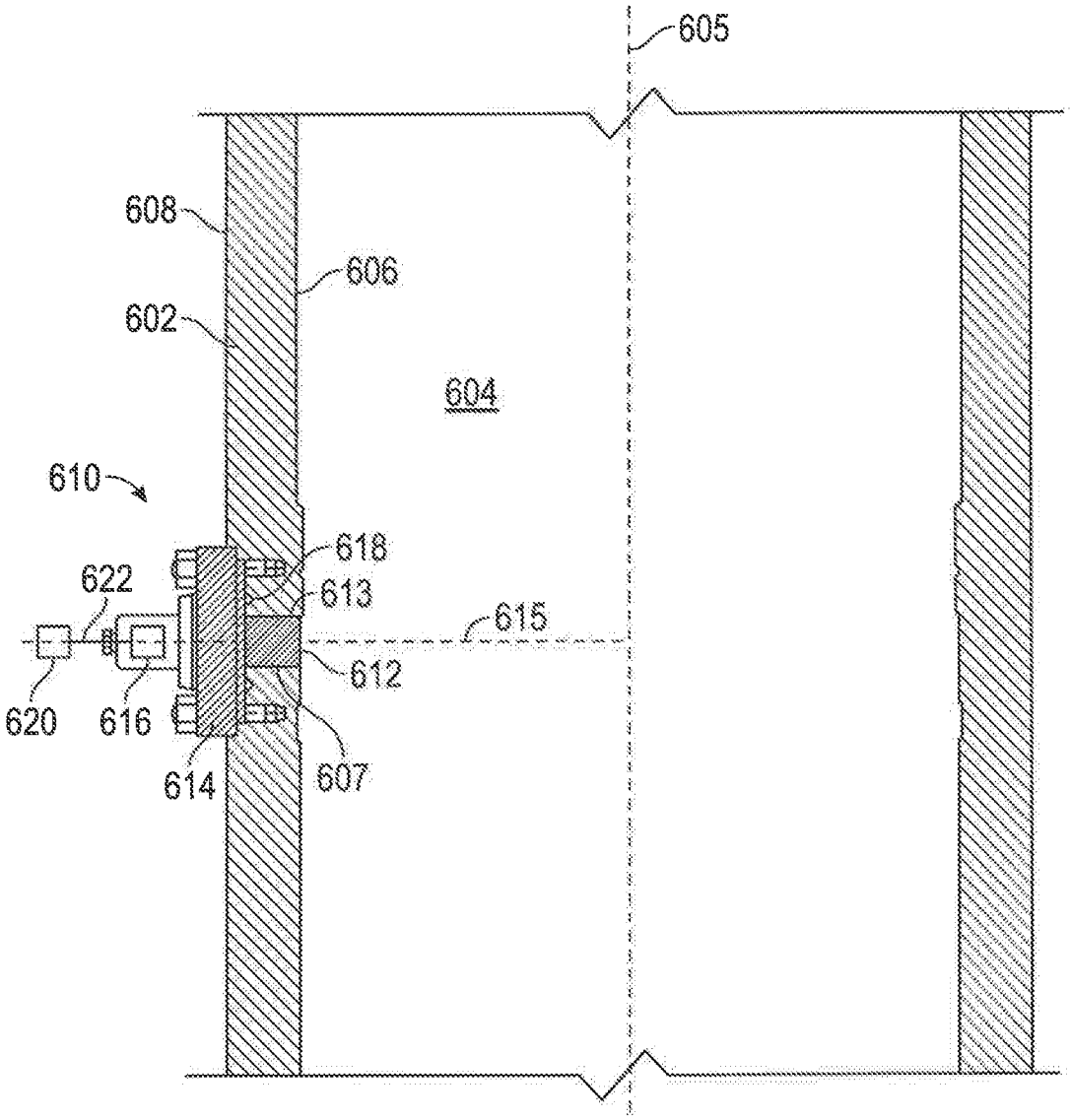
FIG. 9 is a schematic cross-sectional view of another embodiment of a wellhead system of the well system of FIG. 1 in accordance with principles disclosed herein.

Referring to 9, another embodiment of a wellhead system 600 is shown. In this embodiment, wellhead system 600 has a central or longitudinal axis 605 that is disposed coaxial with central axis 15 of well system 10 and generally includes a wellhead 602. Although wellhead system 600 is shown in FIG. 9 as only including wellhead 602, in other embodiments, wellhead system 600 may include additional wellhead components, such as casing or tubing hangers and/or bowls. In the embodiment shown in FIG. 9, wellhead 602 includes a bore 604 defined by a generally cylindrical inner surface 606. Wellhead 602 additionally includes a generally cylindrical outer surface 608. Wellhead 602 further includes a wellbore monitoring assembly 610 configured to provide for nonintrusive monitoring of conditions, such as pressure, temperature, fluid composition, position of wellhead components, etc., within wellbore 8 and bore 604 of wellhead 602.

In the embodiment shown, wellbore monitoring assembly 610 has a central or longitudinal axis 615 that is disposed orthogonal central axis 605 of wellhead system 600 and includes a pressure window 612 disposed in a receptacle 607 of wellhead 602 and extending between outer surface 608 and inner surface 606 of wellhead 602. Wellbore monitoring assembly 610 also includes a sensor housing 614 mounted to the outer surface 608 of wellhead 602 and including a sensor package 616 disposed therein (shown schematically in FIG. 9). Pressure window 612 is configured to provide access to bore 604 of wellhead 602 while sealing bore 604 from the surrounding environment. Specifically, pressure window 612 allows sensor(s) of sensor package 616 to actively and non-intrusively monitor conditions within wellbore 8 and bore 604 of wellhead 602.

In this embodiment, sensor package 616 comprises a pressure sensor and a temperature sensor, where pressure window 612 allows the pressure and temperature sensors of sensor package 616 to actively monitor and measure pressure and temperature within wellbore 8 and bore 604 of wellhead 602. Although in this embodiment sensor package 616 comprises a pressure sensor and a temperature sensor, in other embodiments, sensor package 616 may comprise a single sensor or multiple sensors including sensors configured to measure other parameters beyond pressure and temperature, such as fluid composition or the physical position (e.g., a magnetic sensor and/or an optical sensor) of components disposed in bore 604 of wellhead 602. In this embodiment, pressure window 612 comprises a sapphire glass material sealed to the material comprising wellhead 602, such as sapphire glass produced by Rayotek Scientific Inc. located at 11499 Sorrento Valley Road, San Diego, Calif. 92121. However, in other embodiments, pressure window 612 may comprise other materials configured to provide non-intrusive sensor access to bore 604 of wellhead 602 while sealing bore 604 from the surrounding environment. A seal or gasket 618 is disposed between sensor housing 614 and the outer surface 608 of wellhead 602 to provide a dual-barrier sealing arrangement between the bore 604 of wellhead 602 and the surrounding environment. Particularly, a sealing interface 613 formed between pressure window 612 and the receptacle 607 of wellhead 602 comprises a primary seal while seal 618 forms a secondary seal between bore 604 and the surrounding environment. In this embodiment, the material comprising pressure window 612 (e.g., sapphire glass, etc.) seals against aperture 607 of wellhead 602 at sealing interface 613 to form the primary seal.

In the embodiment shown, wellbore monitoring assembly 610 further comprises a signal transmitter 620 in signal communication with sensor package 616 of sensor housing 614 via a cable or data link 622 extending therebetween. Signal transmitter 620 is configured provide real-time or near real-time transmission of sensor signals (e.g., signals corresponding to pressure measurements, temperature measurements, etc.) outputted by sensor package 616 to signal transmitter 620. In some embodiments, signal transmitter 620 comprises a wireless transmitter configured to transmit a wireless data signal to a signal receiver, such as a receiver disposed on a surface vessel above wellhead system 600 at the waterline. In other embodiments, signal transmitter 620 comprises a hardwired connection between the sensor package 616 and the signal receiver. For instance, in some embodiments transmitter 620 may comprise a hardwired connection routed along a marine riser extending between wellhead 602 and a surface vessel. In this manner, conditions within wellbore 8 and bore 604 of wellhead 602 may be monitored in real-time. For instance, sensor package 616 may be used to assist in positioning components within wellhead 602 via real-time optical or visual monitoring of bore 604. In other embodiments, wellbore monitoring assembly 610 may not include signal transmitter 620, and instead, may comprise a data storage and processing unit configured to store data provided by sensor package 616 for later retrieval.

Figure 10:
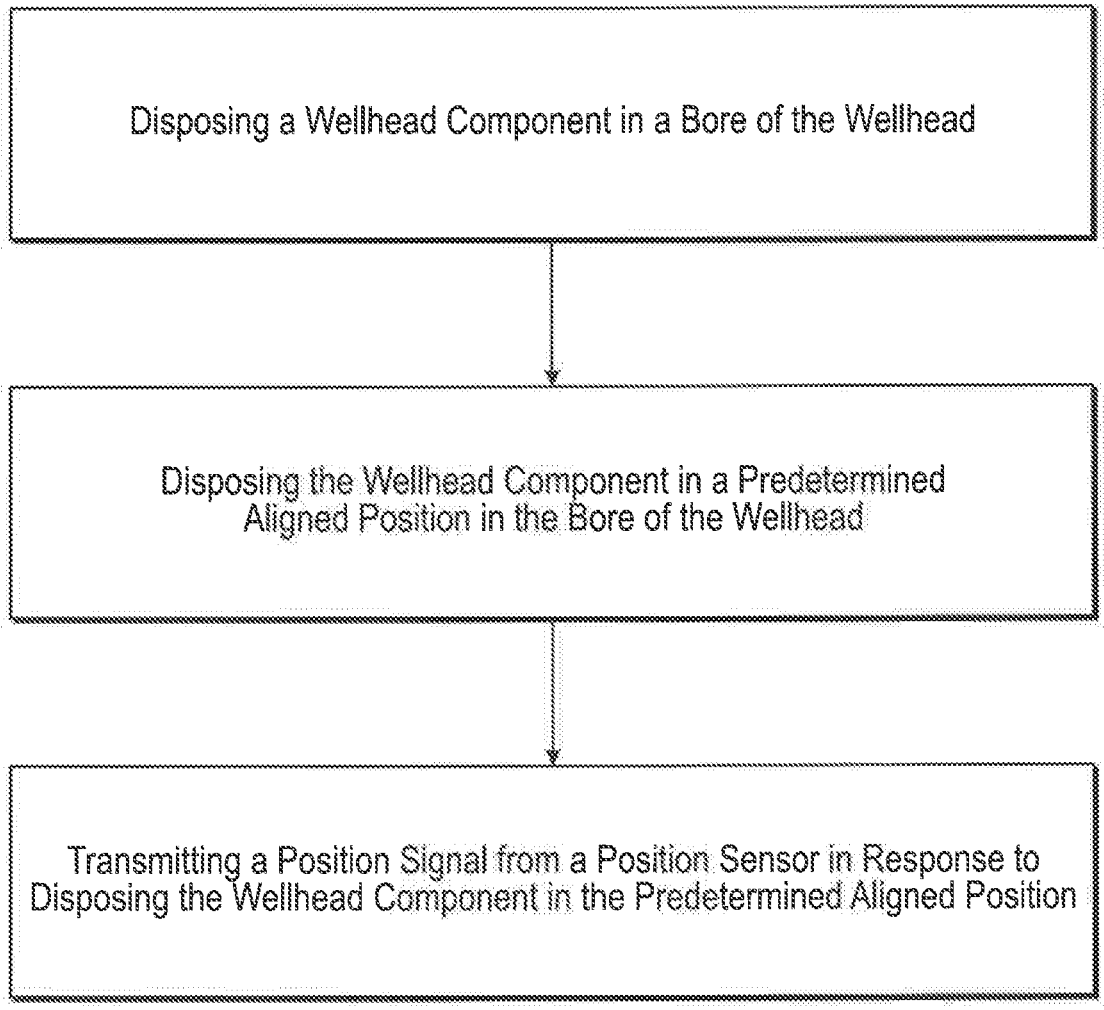
FIG. 10 is a flowchart of an embodiment of a method of landing a wellhead component in a wellhead is shown in accordance with principles disclosed herein.

Referring to FIG. 10, an embodiment of a method 700 of landing a wellhead component in a wellhead is shown. Beginning at block 702 of method 700, a wellhead component (e.g., wellhead component 150 of wellhead system 100) is disposed in a bore of a wellhead (e.g., wellhead 102 of wellhead system 100). At block 704 of method 700, the wellhead component is disposed in a predetermined aligned position (e.g., the position of wellhead component 150 shown in FIGS. 4A and 4B) in the bore of the wellhead. At block 706 of method 700, a position signal is transmitted from a position sensor (e.g., position or acoustic sensor 202 of position indication system 200) in response to disposing the wellhead component in the predetermined aligned position. In some embodiments, the position signal is transmitted in response to physically engaging a landing shoulder of the wellhead component (e.g., landing shoulder 162 of wellhead component 150) with a landing shoulder of a wellhead (e.g., landing shoulder 112 of wellhead 102).

In some embodiments, the position signal is transmitted in response to aligning a locking ring (e.g., locking ring 450 of wellhead system 400) with a locking groove (e.g., locking groove 408 of wellhead 402 of wellhead system 400) disposed in an inner surface of the wellhead (e.g., wellhead 402). In certain embodiments, the position signal is transmitted in response to an acoustic signal generator (e.g., acoustic signal generator 210 of position indication system 200) coupled to the wellhead component generating an acoustic position signal. In certain embodiments, the position signal is transmitted in response to aligning a magnetic member (e.g., magnetic member 352 of position indication system 350) of the wellhead component with the position sensor (e.g., position or magnetic sensor 354 of position indication system 350).

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A wellhead system, comprising:

a wellhead comprising a position sensor disposed in an inner surface of the wellhead; and a wellhead component to be installed in the wellhead, the wellhead component comprising a position indicator disposed in an outer surface of the wellhead component and configured to contact a landing shoulder of the wellhead as the wellhead component enters into a predetermined aligned position in the wellhead;

wherein the position sensor is configured to transmit a position signal in response to the position indicator contacting the landing shoulder of the wellhead and the wellhead component entering into a predetermined aligned position in the wellhead.

2. The wellhead system of claim 1, wherein the wellhead component comprises a tubing or casing hanger.

3. The wellhead system of claim 2, wherein the predetermined aligned position of the tubing or casing hanger comprises a position where a landing shoulder of the tubing or casing hanger physically engages a landing shoulder of the wellhead.

4. The wellhead system of claim 1, wherein the wellhead component comprises a bowl and a locking ring configured to releasably couple the bowl to the wellhead, wherein the bowl comprises a landing shoulder.

5. The wellhead system of claim 4, wherein the predetermined aligned position of the bowl comprises a position where the locking ring is aligned with a locking groove disposed in the inner surface of the wellhead.

6. The wellhead system of claim 1, wherein the position indicator comprises a magnetic member and the position sensor comprises a magnetic sensor.

7. The wellhead system of claim 1, wherein the position indicator comprises an acoustic signal generator and the position sensor comprises an acoustic sensor.

8. The wellhead system of claim 7, wherein the acoustic signal generator comprises a shear pin configured to a shear a terminal end thereof in response to the wellhead component entering into the predetermined aligned position.

9. The wellhead system of claim 1, further comprising a signal transmitter in signal communication with the position sensor, wherein the signal transmitter is configured to transmit the position signal in real-time from the position sensor to a location distal the wellhead system.

10. A wellhead system comprising:

a wellhead comprising a bore; and a wellbore monitoring assembly coupled to the wellhead, wherein the wellbore monitoring assembly comprises:

a sensor package disposed in a sensor housing, wherein the sensor package comprises a temperature sensor and a pressure sensor;

a window disposed in a receptacle of the wellhead;

a sealing interface disposed between the window and the receptacle of the wellhead, wherein the sealing interface comprises a primary seal between the bore of the wellhead and the surrounding environment and a gasket disposed between the sensor housing and an outer surface of the wellhead, wherein the gasket comprises a secondary seal between the bore of the wellhead and the surrounding environment.

11. The wellhead system of claim 10, wherein the sensor package is configured to monitor conditions in the bore of the wellhead via the window disposed in the wellhead.

12. The wellhead system of claim 10, wherein the window comprises a sapphire glass material.

13. The wellhead system of claim 10, further comprising a signal transmitter in signal communication with the sensor package, wherein the signal transmitter is configured to transmit a sensor signal from the sensor package in real-time to a location distal the wellhead system.

14. A method of landing a wellhead component in a wellhead, comprising:

disposing the wellhead component in a bore of the wellhead;

disposing the wellhead component in a predetermined aligned position in the bore of the wellhead, whereby a position indicator disposed in an outer surface of the wellhead component contacts a landing shoulder of the wellhead as the wellhead component enters into the predetermined aligned position; and transmitting a position signal from the position sensor in response to contacting the landing shoulder of the wellhead with the position indicator and disposing the wellhead component in the predetermined aligned positioned.

15. The method of claim 14, further comprising transmitting the position signal in response to physically engaging a landing shoulder of the wellhead component with the landing shoulder of the wellhead.

16. The method of claim 14, further comprising transmitting the position signal in response to aligning a locking ring with a locking groove disposed in an inner surface of the wellhead.

17. The method of claim 14, further comprising transmitting the position signal in response to an acoustic signal generator coupled to the wellhead component generating an acoustic position signal.

18. The method of claim 14, further comprising transmitting the position signal in response to aligning a magnetic member of the wellhead component with the position sensor.

* * * * *